United States Patent [19]

Donohue

[11] 4,382,980

[45] May 10, 1983

[54] MAGNESIUM COMPOSITIONS AND PROCESS FOR FORMING MGO FILM

[75] Inventor: Paul C. Donohue, Wilmington, Del.

[73] Assignee: E. I. Du Pont de Nemours and Company, Wilmington, Del.

[21] Appl. No.: 242,041

[22] Filed: Mar. 9, 1981

Related U.S. Application Data

[63] Continuation of Ser. No. 18,404, Mar. 7, 1979, abandoned.

[51] Int. Cl.[3] ..... B05D 5/12

[52] U.S. Cl. ..... 427/77; 106/163 R; 106/194; 252/521; 427/226; 427/282; 427/287; 501/108

[58] Field of Search ..... 427/226, 282, 287, 77; 106/14.05, 287.18, 194, 163 R, 169, 58, 178, 106/171, 181; 252/521; 524/436

[56] References Cited

U.S. PATENT DOCUMENTS

| | | | |
|---|---|---|---|
| 1,636,319 | 7/1927 | Pitman | 106/194 |
| 2,086,543 | 7/1937 | Dreyfus | 106/194 |
| 2,213,252 | 9/1940 | Mitchell | 106/194 |
| 2,362,510 | 11/1944 | Stutsman | 427/77 |
| 2,664,361 | 12/1953 | Zabel | 427/77 |
| 2,805,965 | 9/1957 | Robinson | 427/79 |
| 2,933,475 | 4/1960 | Hoover et al. | 106/194 |
| 3,081,200 | 3/1963 | Tompkins | 117/213 |
| 3,087,831 | 4/1963 | Browne | 117/35 |
| 3,107,177 | 10/1963 | Saunders | 117/211 |
| 3,176,678 | 4/1965 | Langley | 126/270 |
| 3,176,679 | 4/1965 | Langley | 126/270 |
| 3,185,586 | 5/1965 | Saunders et al. | 117/54 |
| 3,323,889 | 6/1967 | Carl et al. | 65/60 |
| 3,352,708 | 11/1967 | Lyon et al. | 117/72 |
| 3,373,485 | 3/1968 | Nelson | 427/226 |
| 3,387,994 | 6/1968 | Dunton et al. | 117/124 |
| 3,407,085 | 10/1968 | Kitaj et al. | 117/72 |
| 3,410,710 | 11/1968 | Mochel | 117/33.3 |
| 3,411,934 | 11/1968 | Englehart et al. | 117/33.3 |
| 3,414,429 | 12/1968 | Bruss et al. | 117/69 |
| 3,418,153 | 12/1968 | Levene | 117/72 |
| 3,418,154 | 12/1968 | Rawski | 117/88 |
| 3,445,269 | 5/1969 | Bruss, Jr. et al. | 117/88 |
| 3,486,931 | 12/1969 | Dreyfus | 117/201 |
| 3,489,588 | 1/1970 | Mansur et al. | 117/38 |
| 3,494,779 | 2/1970 | Pappalardo et al. | 117/33.5 |
| 3,498,825 | 3/1970 | Wiens | 117/72 |
| 3,510,343 | 5/1970 | Twells | 117/70 |
| 3,528,845 | 9/1970 | Donley | 117/124 |
| 3,536,526 | 10/1970 | Month | 117/213 |
| 3,560,236 | 2/1971 | Orth | 427/226 |
| 3,617,341 | 11/1971 | Fefferman | 427/226 |
| 3,645,778 | 2/1972 | Nesteruk | 117/93.4 |
| 3,658,568 | 4/1972 | Donley | 117/46 |
| 3,660,061 | 5/1972 | Donley et al. | 65/32 |
| 3,687,723 | 8/1972 | Hutchins | 117/222 |
| 3,702,780 | 11/1972 | Withers | 117/104 R |
| 3,773,554 | 11/1973 | Scrutton et al. | 117/215 |
| 3,775,999 | 12/1973 | Foster et al. | 65/50 |
| 3,778,243 | 12/1973 | Johnston | 65/58 |
| 3,799,795 | 3/1974 | Crawford et al. | 117/54 |
| 3,852,098 | 12/1974 | Bloss et al. | 117/106 R |
| 3,873,218 | 2/1975 | Dobischek | 427/77 |
| 3,925,050 | 12/1975 | Kushihashi et al. | 65/60 |
| 3,957,014 | 5/1976 | Phillips et al. | 427/226 |
| 3,962,490 | 6/1976 | Ward | 427/226 |
| 3,975,201 | 8/1976 | Greenstein | 427/226 |
| 3,982,941 | 9/1976 | Inskip | 427/226 |
| 3,984,591 | 10/1976 | Plumat et al. | 427/165 |
| 4,025,667 | 5/1977 | Tomb et al. | 427/226 |
| 4,025,669 | 5/1977 | Greenstein | 427/226 |
| 4,059,544 | 11/1977 | Yamaguchi et al. | 427/226 |
| 4,083,614 | 4/1978 | Aboelfotoh et al. | 316/19 |
| 4,092,444 | 5/1978 | Kilichowski | 427/64 |
| 4,148,940 | 4/1979 | Breininger et al. | 427/226 |
| 4,188,199 | 2/1980 | Van Laethem et al. | 65/60 |

FOREIGN PATENT DOCUMENTS

| | | |
|---|---|---|
| 1521531 | of 0000 | Fed. Rep. of Germany . |
| 1455148 | of 0000 | United Kingdom . |

OTHER PUBLICATIONS

Urade et al., "A Protecting Layer for Dielectric in AC Plasma Panels", in *Transactions on Electron Devices,* vol. 23, No. 3, Mar. 1976, pp. 313–318.

Byrum, B. W., "Surface Aging Mechanisms of AC Plasma Display Panels", in *Transactions on Electron Devices,* vol. 22, No. 9, Sep. 1975, pp. 685–691.

Aboelfotoh et al., "Influence of Secondary—Electron Emission From MgO Surfaces on Voltage Breakdown Curves in Penning Mixtures for Insulated Electrode Discharges", in *Journal of Applied Physics,* vol. 48, No. 11, Nov. 1977, pp. 4754–4759.

*Primary Examiner*—Michael R. Lusignan
*Assistant Examiner*—Janyce A. Bell

[57] ABSTRACT

A syrup of a magnesium compound is provided, which is screen printable onto a surface and pyrolyzable to form a MgO film thereon. The syrup contains solvent, organic magnesium compound dissolved in the solvent, and organic polymer thickener dissolved in the solvent.

4 Claims, No Drawings

MAGNESIUM COMPOSITIONS AND PROCESS FOR FORMING MGO FILM

This is a continuation, of application Ser. No. 18,404 filed Mar. 7, 1979, now abandoned.

TECHNICAL FIELD

This invention relates to magnesium compositions which are useful for screen printing and pyrolysis to form an MgO film.

BACKGROUND ART

M. O. Aboelfotoh and J. A. Lorenzen, "Influence of Secondary-Electron Emission from MgO Surfaces on Voltage-Breakdown Curves in Penning Mixtures for Insulated-Electrode Discharges," J. Appl. Phys., Vol. 48, No. 11, 4754–4759 (1977) discloses the formation of a MgO film on the surface of an a-c plasma display panel by sputtering, which involves use of an electron gun to volatilize a magnesium compound and then deposit it as a MgO film on the surface of the panel to a thickness of about 3000 Å. The disadvantage of this method of forming the MgO film is that sputtering is expensive.

DISCLOSURE OF INVENTION

The present invention provides a more economical method of forming an MgO film and a composition therefor.

The composition of the present invention is a screen printable syrup comprising organic solvent, organic magnesium compound soluble in the solvent, and organic polymer thickener soluble in the solvent. Solution of the organic polymer thickener in the solvent thickens the solution so that it is syrup-like in consistency at ordinary room temperature (20° C.). The components of the syrup are selected so that the syrup is pyrolyzable to form a transparent, colorless MgO film.

The process of the invention is conducted by screen printing of the syrup onto the desired surface, followed by pyrolyzing the syrup to form the MgO film on the surface. This process is useful in place of sputtering to form an MgO film on the surface of an a-c plasma display panel.

FURTHER DESCRIPTION OF THE INVENTION AND BEST MODE

The composition of the present invention contains three essential ingredients, organic magnesium compound, organic solvent and organic polymer thickener. The criteria for selecting these ingredients and preferred ingredients are set forth hereinafter.

The organic magnesium compound is selected so that it is pyrolyzable to MgO film and is soluble in the organic solvent used at ordinary room temperature. Selection of the organic magnesium compound can be subject to the pyrolysis temperature that can be used. For example, current surfaces of a-c plasma displays are made of lead-rich glass which undergoes a glass transition at a temperature above 450° C. To avoid this transition, it is preferred that the organic magnesium compound is pyrolyzable to MgO film at a temperature up to 450° C.

Examples of magnesium organic compounds that can be used are the oxygen-containing organic magnesium compounds such as magnesium carboxylates, e.g., magnesium cyclohexanebutyrate, magnesium diketones, e.g., magnesium acetylacetonate, and magnesium alcoholates, e.g., magnesium ethoxide. Preferably all the atoms bonded to the magnesium atom in the compound are oxygen atoms and organic carbon atoms are bonded to these oxygen atoms.

The organic solvent component is selected so as to dissolve the remaining components of the syrup and to depart from the syrup without leaving any detectable residue during pyrolysis. Typically, most or all of the solvent will evaporate in a drying step preceding any heating to pyrolyze other components of the syrup. Such heating will also volatilize any remaining solvent.

Examples of solvents are the glycol ethers, such as the Cellosolves®, e.g., methyl, butyl and hexyl, the Carbitols®, e.g., methyl, butyl, and hexyl, and the triglycols, e.g., methoxy, ethoxy, and butoxy, the alcohols, such as butanol and isopropanol, and the acetates, such as butyl carbitol acetate and dibutyl acetate.

The organic polymer thickener is selected so as to dissolve in the solvent that also dissolves the organic magnesium compound and to pyrolyze leaving no detectable residue which would prevent formation of the MgO film or would color it. Examples of thickeners are the cellulose polymers, preferably being noncarboxylated, for example, hydroxyethylcellulose, propoxyethylcellulose, and ethylcellulose. Preferably, the organic polymer thickener pyrolyzes to no detectable residue at temperatures up to 450° C.

The syrup composition can be made by first dissolving the organic magnesium compound in the solvent and then dissolving the organic polymer thickener in the solution to get the syrup-like consistency desired. Without the organic polymer thickener, the solution would be too flowable to be screen printable. The polymer-free solution would just run through the screen onto the surface to be printed and then would spread out on such surface without reproducing the desired screen pattern. The thickening effect provided by the organic polymer thickener limits the flowability of the resultant syrup so that it can be screen printed by conventional thick-film paste screen printing techniques to a faithful reproduction of the screen image on the surface on which the syrup is screen printed.

The organic magnesium compound and organic polymer thickener may not easily dissolve in the same solvent. In the case of magnesium acetylacetonate, this compound easily dissolves in hexyl Carbitol® but ethyl cellulose thickener does not dissolve until heated for about one hour at 155° C. in the solvent, whereupon the polymer rapidly goes into solution.

The syrup of the present invention is a solution, i.e., no solids are observable by the naked eye. This syrup differs from the usual screen printing media, in that such media normally contain solids.

The organic polymer thickener generally imparts a viscosity of at least 3 Pa.S measured using a Brookfield viscometer at 10 rpm and 25° C. A viscosity greater than 200 Pa.S is generally not required. Unexpectedly, while the organic polymer thickener does thicken the syrup, it does not prevent the MgO film from being formed upon pyrolysis, i.e., not only must the organic portion of the magnesium compound pyrolyze to MgO, but the organic polymer thickener must also pyrolyze at the same time without preventing formation of the MgO film. The pyrolysis products of the magnesium compound, except for MgO, and the organic polymer thickener, and any residue of the solvent after drying are volatile at the pyrolysis temperature used, so as to yield the colorless, transparent MgO film. Preferably, the syrup of the present invention has a viscosity of from 10 Pa.S to 50 Pa.S.

The syrup of the present invention will typically contain from 1 to 15% organic magnesium compound, 5 to 20% organic polymer thickener, and 65 to 90% solvent, all percents being by weight based on the total weight of these three components. Preferred compositions contain 4 to 8%, 6 to 15%, and 75 to 85% of organic magnesium compound, organic polymer thickener, and organic solvent, respectively. The amount of thickener is selected to give the syrup the viscosity desired; such amount will vary with the particular thickener selected and the inherent viscosity of the thickener.

The proportion of components and viscosity are selected so as to give an MgO film upon screen printing and pyrolysis of at least about 1000 Å.

It has been found that shelf life (storage stability) of the syrup at ordinary room temperature is improved, i.e., no solids form during standing, if the components of the syrup are dried, preferably before combining into the composition. Drying can be done by heating and/or desiccation of each component. Organic magnesium compounds are available in hydrated form; the drying should remove the water of hydration from the compound. Solvents such as alcohols typically contain water, and this is most readily removed by desiccation in the presence of a desiccant such as $CaCl_2$ or mixing $CaH_2$ with the solvent at near its boiling point, followed by filtering out the $CaH_2$ particles. The resultant anhydrous or dried syrup has a shelf life in excess of two months, whereas without drying, solids begin to appear after about three weeks storage.

A preferred a-c plasma display panel is made by firing a thick film silver conductor composition after printing in a conductor line pattern into a substrate, the composition comprising: (A) 50–85% of the weight of the composition, of silver particles of 0.05–20 micrometers in size; (B) 1–10% of the weight of the composition, of inorganic non-glass forming refractory materials or their precursors, such as aluminum oxide, zirconium oxide, cobalt/iron/chromium oxide, aluminum and copper, having a particle size range of 0.05 –44 micrometers with at least 80% by weight of the particles in the 0.1–5 micrometer range; (C) 5–20% of the weight of the composition, of glass frit having a softening point range of 325°–600° C. such as lead borosilicate-based glass; and (D) 10–30% of the weight of the composition, of vehicle such as a UV polymerizable solution of polymethyl methacrylate and a polyfunctional monomer or a non-UV polymerizable solution of ethyl cellulose.

The overglaze composition preferably utilized contains a glass frit of the composition (mole %): PbO (68.2), $SiO_2$ (12.0), $B_2O_3$ (14.1), and CdO (5.7), having a softening point of approximately 480° C. The overglaze composition, dispersed in an ethyl cellulose-based vehicle, is screen printed over the fired conductor, dried, and then fired at a temperature and for a time sufficient to produce a clear, smooth coating. It is on this coating that the syrup of the present invention is printed and pyrolyzed.

Examples of the composition and process of the present invention, in which parts and percents are by weight unless otherwise indicated, are as follows:

EXAMPLE 1

On a hot plate while stirring, 2.5 grams Mg cyclohexanebutyrate was dissolved in 30 ml dibutylacetate. Two grams ethyl cellulose (viscosity of 22 cps at 5% concentration in 80:20 toluene-ethanol solvent at 25° C.) was added and stirring and heating continued to about 150° C. for about 60 minutes to dissolve the polymer thickener. When dissolved, the syrup was centrifuged. The centrifuged syrup had a viscosity estimated to be between 10 to 50 Pa.S. The syrup was screen printed onto glass slides which could be the surface of an a-c plasma display panel and dried and then fired in a belt furnace at 470° C. peak temperature. The MgO film was colorless and transparent indicating complete pyrolysis of the organic moieties of the magnesium compound and thickener. When this experiment was repeated except using a 450° C. peak temperature, the MgO film was brown; indicating incomplete pyrolysis.

EXAMPLE 2

One gram of Mg acetylacetonate was dissolved in 25 ml n-hexyl Carbitol® while stirring on—hot plate. Then 2 grams ethyl cellulose of Ex. 1 was added and dissolved after standing for about one hour. The resultant syrup had a viscosity estimated to be between 10 to 50 Pa.S and was printed on glass slides, dried, and then fired at 460° C. in a box furnace for 1 hour. The MgO films looked good by microscopy. Interferometry on three films indicated smoothness averaging 777 Å thick.

It was observed that this syrup precipitated a white material on standing for about 3 weeks. Later preparations starting with dried Mg acetylacetonate, dried polymer, and dried solvent and prepared at a somewhat higher temperature were stable in excess of several months.

EXAMPLE 3

Two grams of dried (125° C., 1 hour) Mg acetylacetonate was dissolved in 30 ml n-hexyl Carbitol by heating on a hot plate while stirring; 3 grams of ethyl cellulose of Ex. 1 was added and heating and stirring continued until dissolved. While hot, the solution was centrifuged to remove any undissolved material and impurities. The resultant syrup had a viscosity of about 50 Pa.S.

The syrup was tested by screen printing on microscope slides, allowed to level for about 10 minutes, dried 10 minutes at 120° C. and fired on a belt furnace with a 20 minute, 450° C. peak temperature.

Microscopic examination showed a good looking smooth, continuous bluish MgO film. Thickness measured by interferometry was 1470 Å.

To achieve thicker films, some slides were reprinted and fired as before. Thickness measurements showed 2058 A for two coats and 2711 Å for three coats.

EXAMPLE 4

Three grams of Mg acetylacetonate was dissolved in 20 ml n-hexyl carbitol on a hot plate; 3 grams N-22 ethyl cellulose of Ex. 1 was added and dissolved. While hot, the solution was centrifuged. The syrup had a viscosity estimated to be between 10 to 50 Pa.S. The syrup was tested as described in Example 3 and the resulting MgO film looked good.

I claim:

1. A screen-printable composition comprising (a) 1 to 15% by weight of an anhydrous organic magnesium compound pyrolyzable below 450° C. selected from the group consisting of magnesium alcoholates and magnesium diketones and (b) 5 to 20% by weight of a noncarboxylated cellulosic polymer pyrolyzable below 450°

C., both completely dissolved in (c) 65 to 90% by weight of a nonaqueous alcohol solvent, the solution having a Brookfield viscosity of 3–200 Pa.S.

2. The composition of claim 1 in which the magnesium diketone compound is magnesium acetylacetonate.

3. A method for forming a film of MgO on a ceramic surface comprising (a) applying thereto a thin layer of the composition of claim 1, (b) drying the layer, and (c) firing the dried layer at a temperature below 450° C. to volatilize the solvent and pyrolyze the organic magnesium compound.

4. The method of claim 3 in which the ceramic surface is the surface of an a-c plasma display panel.

* * * * *